US011421681B2

(12) United States Patent
Raskar et al.

(10) Patent No.: US 11,421,681 B2
(45) Date of Patent: Aug. 23, 2022

(54) MULTIPLE-COMPRESSOR SYSTEM WITH SUCTION VALVE AND METHOD OF CONTROLLING SUCTION VALVE

(71) Applicant: Emerson Climate Technologies, Inc., Sidney, OH (US)

(72) Inventors: Prashant Rangnath Raskar, Ahmednagar (IN); Douglas Patrick Pelsor, Hilliard, OH (US); Asmita Praveen Mehendarge, Pune (IN)

(73) Assignee: EMERSON CLIMATE TECHNOLOGIES, INC., Sidney, OH (US)

( * ) Notice: Subject to any disclaimer, the term of this patent is extended or adjusted under 35 U.S.C. 154(b) by 167 days.

(21) Appl. No.: 16/387,694

(22) Filed: Apr. 18, 2019

(65) Prior Publication Data

US 2019/0323497 A1 Oct. 24, 2019

(30) Foreign Application Priority Data

Apr. 19, 2018 (IN) ..... 201821014837

(51) Int. Cl.
*F04B 53/18* (2006.01)
*F04B 49/22* (2006.01)
(Continued)

(52) U.S. Cl.
CPC ..... *F04B 53/18* (2013.01); *F04B 23/04* (2013.01); *F04B 39/0207* (2013.01); *F04B 49/22* (2013.01)

(58) Field of Classification Search
CPC ..... F04B 23/04; F04B 39/0207; F04B 41/06; F04B 49/22; F04B 53/18; F04B 39/02;
(Continued)

(56) References Cited

U.S. PATENT DOCUMENTS 3,542,338 A * 11/1970 Scaramucci ..... F16K 5/0605 251/209
3,777,509 A * 12/1973 Muench ..... F25B 31/004 62/470
(Continued)

FOREIGN PATENT DOCUMENTS

CN 1333450 A 1/2002
CN 203161535 U 8/2013
(Continued)

OTHER PUBLICATIONS

Office Action regarding U.S. Appl. No. 15/445,137, dated Oct. 2, 2019.
(Continued)

*Primary Examiner* — Devon C Kramer
*Assistant Examiner* — Joseph S. Herrmann
(74) *Attorney, Agent, or Firm* — Harness, Dickey & Pierce, P.L.C.

(57) ABSTRACT

A climate-control system may include first and second compressors, first and second suction valves, and a control module. The first and second compressors each include a shell and a compression mechanism. The shells define suction chambers from which the compression mechanisms draw working fluid. The shells include suction inlets through which working fluid is drawn into the suction chambers. The first suction valve may be movable between a fully open position and a partially closed position and may control a flow of working fluid through the first suction inlet. The second suction valve may be movable between a fully open position and a partially closed position and may control a flow of working fluid through the second suction inlet. The control module may control positions of the first and second suction valves to control lubricant levels in the first and second shells.

20 Claims, 4 Drawing Sheets

(51) Int. Cl.
*F04B 23/04* (2006.01)
*F04B 39/02* (2006.01)

(58) Field of Classification Search
CPC .... F04C 23/008; F04C 23/001; F04C 23/003; F04C 2270/24; F04C 2240/809; F04C 15/0092; F04C 29/021; F25B 31/002; F25B 2500/16; F25B 2600/25; F25B 2600/2515
See application file for complete search history.

(56) References Cited

U.S. PATENT DOCUMENTS

| | | | | |
|---|---|---|---|---|
| 4,179,248 | A | 12/1979 | Shaw | |
| 4,383,802 | A * | 5/1983 | Gianni | F01M 11/12 417/12 |
| 4,750,337 | A * | 6/1988 | Glamm | F04B 39/0207 62/468 |
| 4,979,885 | A | 12/1990 | Yasuda et al. | |
| 5,385,453 | A | 1/1995 | Fogt et al. | |
| 5,584,949 | A | 12/1996 | Ingram | |
| 5,842,354 | A * | 12/1998 | Kawasumi | B60H 1/3214 62/206 |
| 5,988,223 | A | 11/1999 | Kanzaki et al. | |
| 6,206,652 | B1 * | 3/2001 | Caillat | A47F 3/04 417/298 |
| 6,213,731 | B1 | 4/2001 | Doepker et al. | |
| 6,273,427 | B1 | 8/2001 | Simmons et al. | |
| 6,428,296 | B1 * | 8/2002 | Elson | F04C 18/0215 418/55.6 |
| 6,461,120 | B2 * | 10/2002 | Harakawa | F04C 29/045 417/366 |
| 6,474,087 | B1 * | 11/2002 | Lifson | F04C 29/0014 62/199 |
| 6,679,072 | B2 | 1/2004 | Pham et al. | |
| 6,823,686 | B2 | 11/2004 | Chumley et al. | |
| 8,459,053 | B2 | 6/2013 | Pham et al. | |
| 8,485,789 | B2 | 7/2013 | Gu et al. | |
| 8,585,382 | B2 | 11/2013 | Akei et al. | |
| 8,616,014 | B2 | 12/2013 | Stover et al. | |
| 9,273,678 | B2 * | 3/2016 | Bonnefoi | F25B 31/004 |
| 9,360,011 | B2 * | 6/2016 | Perevozchikov | F25B 49/02 |
| 9,470,230 | B2 * | 10/2016 | Koyama | F04B 39/0261 |
| 9,551,351 | B2 | 1/2017 | De Bernardi et al. | |
| 10,081,226 | B2 * | 9/2018 | Connell | B60H 1/323 |
| 10,941,772 | B2 | 3/2021 | Schaefer et al. | |
| 2005/0244286 | A1 | 11/2005 | Palma et al. | |
| 2010/0186433 | A1 * | 7/2010 | Galante | F04C 29/04 62/115 |
| 2011/0138831 | A1 | 6/2011 | Ogata et al. | |
| 2013/0255309 | A1 | 10/2013 | Wu et al. | |
| 2013/0298594 | A1 | 11/2013 | Bonnefoi et al. | |
| 2014/0037484 | A1 | 2/2014 | Fraser et al. | |
| 2014/0241926 | A1 | 8/2014 | Fraser | |
| 2014/0345307 | A1 | 11/2014 | Bagley et al. | |
| 2017/0176074 | A1 | 6/2017 | Crolius et al. | |
| 2017/0268513 | A1 | 9/2017 | Schaefer et al. | |
| 2018/0050578 | A1 | 2/2018 | Connell et al. | |

FOREIGN PATENT DOCUMENTS

| | | | |
|---|---|---|---|
| CN | 103335436 | A | 10/2013 |
| CN | 205245597 | U | 5/2016 |
| CN | 105473856 | B | 7/2017 |
| CN | 106949681 | A | 7/2017 |
| CN | 107757304 | A | 3/2018 |
| CN | 210801675 | U | 6/2020 |
| EP | 2754980 | A1 | 7/2014 |
| JP | S5876862 | U | 5/1983 |
| JP | S6238888 | A | 2/1987 |
| JP | 2005076515 | A | 3/2005 |

OTHER PUBLICATIONS

Search Report regarding European Patent Application No. 17160627.0, dated Aug. 9, 2017.
Office Action regarding Chinese Patent Application No. 201710150253.0, dated Aug. 10, 2018. Translation provided by Unitalen Attorneys at Law.
Office Action regarding U.S. Appl. No. 15/445,137, dated Nov. 29, 2018.
Office Action regarding U.S. Appl. No. 15/445,137, dated May 22, 2019.
Office Action regarding Indian Patent Application No. 201821014837, dated Jul. 8, 2020.
Office Action regarding U.S. Appl. No. 15/445,137, dated Oct. 5, 2020.
Office Action regarding Chinese Patent Application No. 201910319434.0, dated Nov. 6, 2020. Translation provided by Unitalen Attorneys at Law.
Notice of Allowance regarding U.S. Appl. No. 15/445,137, dated Dec. 21, 2020.
Second Chinese Office Action regarding Application No. 201910319434.0 dated Jul. 2, 2021. English translation provided by Unitalen Attorneys at Law.

* cited by examiner

MULTIPLE-COMPRESSOR SYSTEM WITH SUCTION VALVE AND METHOD OF CONTROLLING SUCTION VALVE

CROSS-REFERENCE TO RELATED APPLICATIONS

This application claims the benefit and priority of Indian Patent Application No. 201821014837, filed Apr. 19, 2018. The entire disclosure of the above application is incorporated herein by reference.

FIELD

The present disclosure relates to a climate-control system, and more particularly, to a multiple-compressor system with a suction valve and to a method of controlling the suction valve.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant such as carbon dioxide) between the indoor and outdoor heat exchangers. During operation of a multiple-compressor system, an oil level in one or more of the compressors may decrease while an oil level in another one or more of the compressors may increase. The present disclosure provides means for and method steps for equalizing the oil levels between the multiple compressors and/or reducing an oil deficit in one of more of the compressors.

Maintaining adequate oil levels in the compressor will improve efficiency and reliability of the compressors and will enable the climate-control system to effectively and efficiently provide a cooling and/or heating effect on demand.

SUMMARY

This section provides a general summary of the disclosure, and is not a comprehensive disclosure of its full scope or all of its features.

The present disclosure provides a climate-control system that may include a first compressor, a second compressor, a first suction valve, a second suction valve, and a control module. The first compressor includes a first shell and a first compression mechanism. The first shell may define a first suction chamber from which the first compression mechanism draws working fluid. The first shell may include a first suction inlet through which working fluid is drawn into the first suction chamber. The second compressor includes a second shell and a second compression mechanism. The second shell may define a second suction chamber from which the second compression mechanism draws working fluid. The second shell may include a second suction inlet through which working fluid is drawn into the second suction chamber. The first suction valve may be movable between a fully open position and a partially closed position and may be configured to control a flow of working fluid through the first suction inlet. The second suction valve may be movable between a fully open position and a partially closed position and may be configured to control a flow of working fluid through the second suction inlet. The control module may be in communication with the first and second suction valves and may control positions of the first and second suction valves to control lubricant levels in the first and second shells.

In some configurations of the climate-control system of the above paragraph, the climate-control system includes an additional one or more compressors, each of which has its own suction valve.

In some configurations of the climate-control system of one or more of the above paragraphs, the control module determines positions of the first and second suction valves based on a predefined operating-envelope map.

In some configurations of the climate-control system of one or more of the above paragraphs, the control module controls the positions of the first and second suction valves based on which of the first and second compressors are operating and which are in a shutdown state.

In some configurations of the climate-control system of one or more of the above paragraphs, the control module controls the positions of the first and second suction valves based on capacity levels of the first and second compressors.

In some configurations of the climate-control system of one or more of the above paragraphs, the control module controls the positions of the first and second suction valves based on data received from a high-side sensor (e.g., a high-side temperature sensor or a high-side pressure sensor) and a low-side sensor (e.g., a low-side temperature sensor or a low-side pressure sensor).

In some configurations of the climate-control system of one or more of the above paragraphs, the high-side sensor is disposed upstream of an expansion device and downstream of discharge outlets of the first and second compressors, and the low-side sensor is disposed downstream of the expansion device and upstream of the first and second suction inlets.

In some configurations of the climate-control system of one or more of the above paragraphs, the climate-control system includes an evaporator and a suction manifold providing fluid communication between the evaporator and the first and second compressors. The first and second suction valves control a flow of working fluid through the suction manifold.

In some configurations of the climate-control system of one or more of the above paragraphs, the first compression mechanism is disposed within the first suction chamber.

In some configurations of the climate-control system of one or more of the above paragraphs, the second compression mechanism is disposed within the second suction chamber.

In some configurations of the climate-control system of one or more of the above paragraphs, the first and second suction valves are disposed in the first and second suction inlets, respectively.

In some configurations of the climate-control system of one or more of the above paragraphs, the first and second suction valves are movable between the fully open positions and fully closed positions.

In some configurations of the climate-control system of one or more of the above paragraphs, the first and second suction valves are ball valves.

In some configurations of the climate-control system of one or more of the above paragraphs, the positions of the first and second suction valves are determined based on a predefined operating-envelope map.

The present disclosure also provides a method that may include providing a climate-control system including a first compressor and a second compressor, the first and second compressors configured to compress a working fluid and circulate the working fluid throughout the climate-control system; providing a first suction valve controlling a flow of working fluid into the first compressor; providing a second suction valve controlling a flow of working fluid into the second compressor; and controlling lubricant levels within the first and second compressors by adjusting a position of one or both of the first and second suction valves.

In some configurations of the method of the above paragraph, the position of one or both of the first and second suction valves is controlled based on which of the first and second compressors are operating and which are in a shutdown state.

In some configurations of the method of one or more of the above paragraphs, the position of one or both of the first and second suction valves is controlled based on capacity levels of the first and second compressors.

In some configurations of the method of one or more of the above paragraphs, the position of one or both of the first and second suction valves is controlled based on data received from a high-side sensor (e.g., a high-side temperature sensor or a high-side pressure sensor) and a low-side sensor (e.g., a low-side temperature sensor or a low-side pressure sensor).

In some configurations of the method of one or more of the above paragraphs, the method includes determining positions of the first and second suction valves based on an operating-envelope map.

In some configurations of the method of one or more of the above paragraphs, the high-side sensor is disposed upstream of an expansion device and downstream of discharge outlets of the first and second compressors.

In some configurations of the method of one or more of the above paragraphs, the low-side sensor is disposed downstream of the expansion device and upstream of suction inlets of the first and second compressors.

In some configurations of the method of one or more of the above paragraphs, the method includes providing working fluid to the first and second compressors from a suction manifold that fluidly couples an evaporator with suction inlets of the first and second compressors.

In some configurations of the method of one or more of the above paragraphs, the first and second suction valves control a flow of working fluid through the manifold.

In some configurations of the method of one or more of the above paragraphs, the first and second suction valves are disposed in the suction inlets of the first and second compressors, respectively.

In some configurations of the method of one or more of the above paragraphs, the method includes determining positions of the first and second suction valves based on a predefined operating-envelope map.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
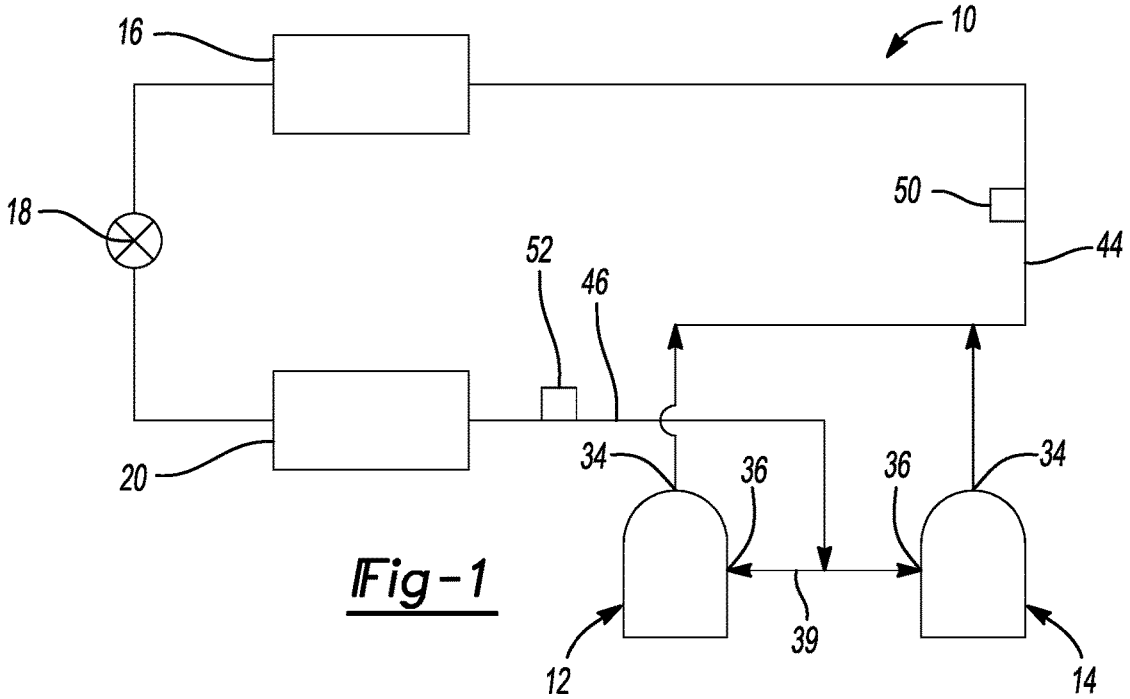
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a first compressor 12, a second compressor 14, a first heat exchanger (e.g., a condenser or gas cooler) 16, an expansion device (e.g., an expansion valve or capillary tube) 18, and a second heat exchanger (e.g., an evaporator) 20. The climate-control system 10 may be a refrigeration system, an air-conditioning system, a heat-pump system, etc. While the climate-control system 10 shown in FIG. 1 includes two compressors, in some configurations, the climate-control system 10 may include more than two compressors.

Figure 2:
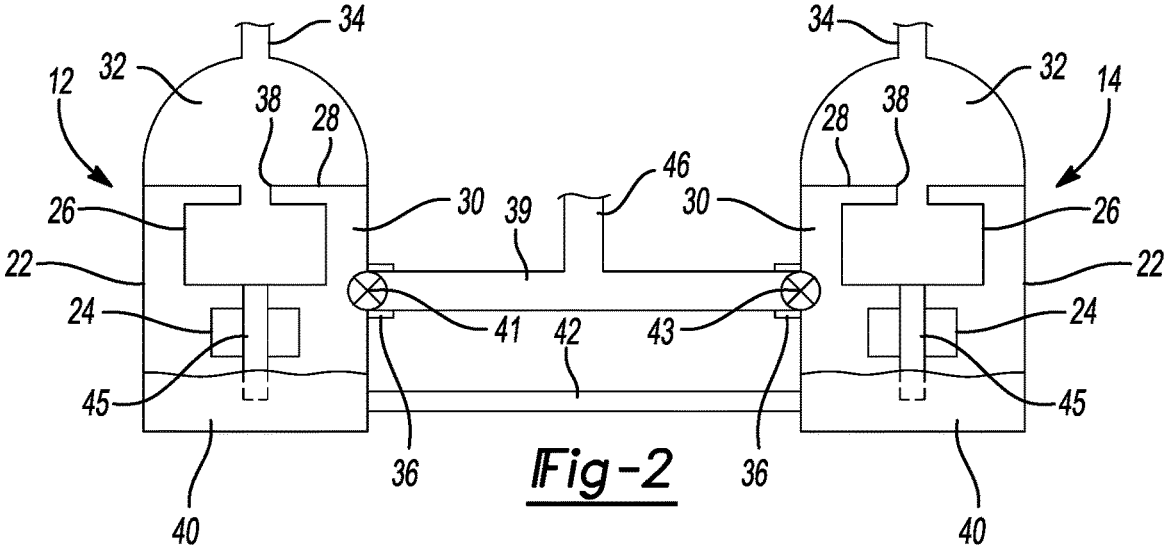
FIG. 2 is a schematic representation of first and second compressors of the climate-control system.

Referring now to FIG. 2, each of the first and second compressors 12, 14 may include a shell 22, a motor 24, and a compression mechanism 26. The shell 22 defines a compressor housing in which the motor 24 and compression mechanism 26 are disposed. The shell 22 may include a partition 28 that separates a suction chamber 30 from a discharge chamber 32. A discharge outlet 34 may be attached to the shell 22 and may receive compressed working fluid from the discharge chamber 32. The partition 28 may include a discharge passage 38 therethrough providing communication between the compression mechanism 26 and the discharge chamber 32. A suction inlet 36 may be attached to the shell 22 and may provide suction-pressure working fluid to the suction chamber 30.

A suction manifold 39 may be fluidly coupled to the suction inlets 36 of both of the compressors 12, 14. A first suction valve 41 may be disposed in or proximate to the suction inlet 36 of the first compressor 12 and may control fluid flow into the first compressor 12 (e.g., fluid flow into the suction chamber 30 of the first compressor 12). A second suction valve 43 may be disposed in or proximate to the suction inlet 36 of the second compressor 14 and may control fluid flow into the second compressor 14 (e.g., fluid flow into the suction chamber 30 of the second compressor 14).

A lower end of the shell 22 may define a lubricant sump 40 containing a volume of liquid lubricant (e.g., oil). A lubricant equalization conduit 42 may extend between the first and second compressor 12, 14 and may be fluidly coupled with oil fittings attached to the shells 22 such that the lubricant equalization conduit 42 is in fluid communication with the lubricant sumps 40 of both of the compressors 12, 14.

The motor 24 may include a stator and a rotor. The stator may be press fit into the shell 22. The rotor may be fixed to a driveshaft 45, and the driveshaft 45 may drive the compression mechanism 26. The compression mechanism 26 may be a scroll compression mechanism including an orbiting scroll and a non-orbiting scroll that include spiral wraps that cooperate to define compression pockets therebetween. It will be appreciated that the compression mechanism 26 could be any other type of compression mechanism, such as a rotary compression mechanism (e.g., with an eccentric rotor rotating within a cylinder, and with a reciprocating vane extending into the cylinder) or a reciprocating compression mechanism (e.g., with a piston reciprocating within a cylinder), for example.

One or both of the compressors 12, 14 may be variable-capacity compressors. That is, one or both of the compressors 12, 14 could be or include one or more of: a multi-stage compression mechanism, a multi-speed or variable-speed motor, a vapor-injection system (e.g., an economizer circuit), a pulse-width-modulated scroll compressor configured for scroll separation (e.g., a digital scroll compressor), and a compressor having capacity-modulation valves configured to leak intermediate-pressure working fluid. It will be appreciated that one or both of the compressors 12, 14 could include any other additional or alternative structure for varying its capacity and/or the operating capacity of the system 10. Example variable-capacity compressors are disclosed in Assignee's commonly owned U.S. Pat. Nos. 8,616,014, 6,679,072, 8,585,382, 6,213,731, 8,485,789 and 8,459,053, the disclosures of which are hereby incorporated by reference. A control module 48 (FIG. 3) may control operation of the compressors 12, 14, including starting up the compressors 12, 14, shutting down the compressors 12, 14, and adjusting or modulating the capacities of the compressors 12, 14.

Referring now to FIGS. 1 and 2, during operation of the climate-control system 10, the compression mechanism 26 of one or both of the compressors 12, 14 may draw suction-pressure working fluid (e.g., a refrigerant such as carbon dioxide, etc.) from their respective suction chambers 30, may compress the working fluid to a higher pressure, and may discharge the compressed working fluid into their respective discharge chambers 32. The compressed working fluid in the discharge chambers 32 of the compressors 12, 14 may flow through the discharge outlets 34 and into a discharge conduit 44.

Working fluid in the discharge conduit 44 may flow through the first heat exchanger 16 where heat is absorbed from the working fluid. From the first heat exchanger 16, the working fluid may flow through the expansion device 18. The pressure and temperature of the working fluid drop as the working fluid flows through the expansion device 18. From the expansion device 18, the working fluid may flow through the second heat exchanger 20, where the working fluid absorbs heat from a space to be cooled. From the second heat exchanger 20, the working fluid flows to the suction manifold 39 via a suction conduit 46. From the suction manifold 39, working fluid may flow into one or both of the compressors 12, 14 through the suction inlets 36. The first and second suction valves 41, 43 control the flow of working fluid into the first and second compressors 12, 14, respectively.

The control module 48 (FIG. 3) may be in communication with the first and second suction valves 41, 43 and may control operation of the first and second suction valves 41, 43 to equalize (or reduce differences between) the pressures of fluid within the suction chambers 30 of the first and second compressors 12, 14. Equalizing the pressures of fluid within the suction chambers 30 of the first and second compressors 12, 14 maintains a balance of lubricant (i.e., equalizes lubricant levels) in the sumps 40 of the first and second compressors 12, 14. This prevents the lubricant level within either of the compressors 12, 14 from getting too low so that both compressors 12, 14 remain adequately lubricated.

Figure 7:
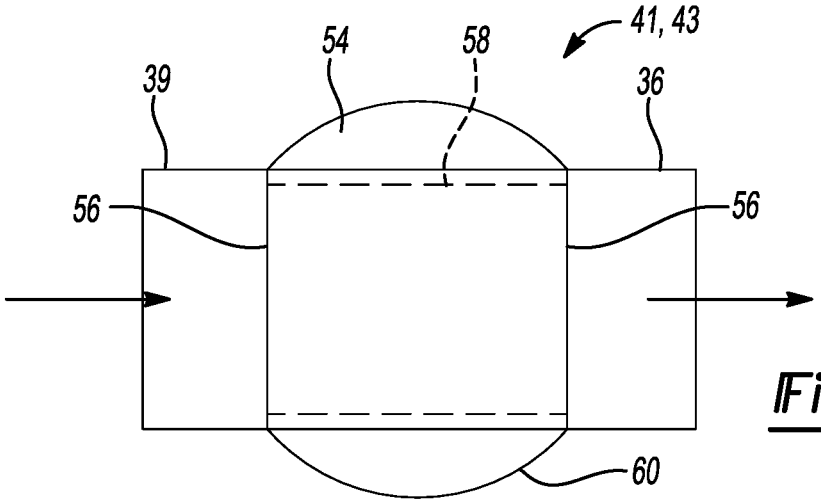
FIG. 7 is a schematic representation of one of the suction valves in a fully open position.
Figure 8:
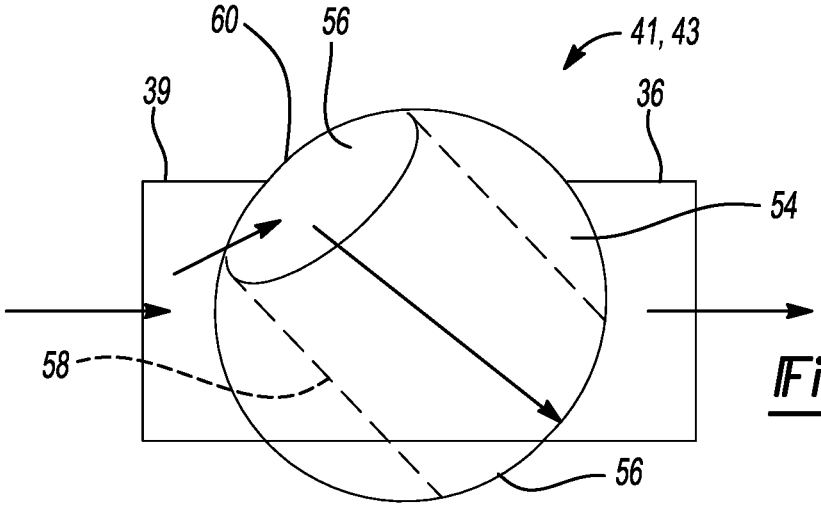
FIG. 8 is a schematic representation of the suction valve in an intermediate position.
Figure 9:
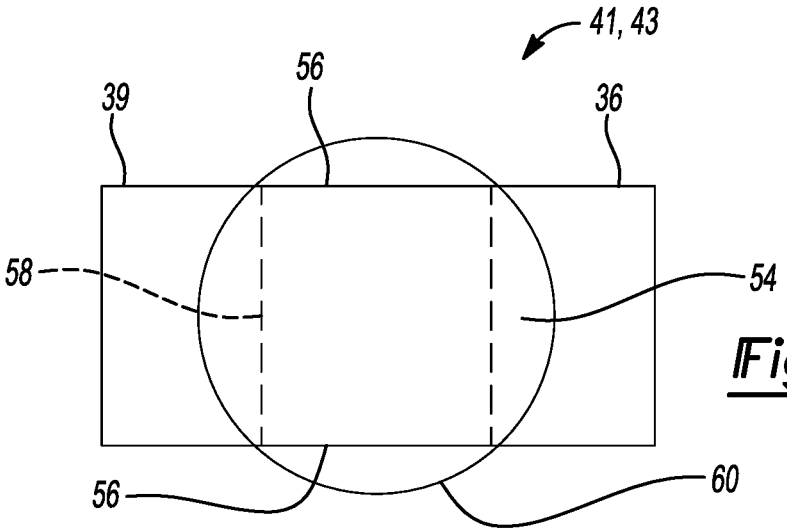
FIG. 9 is a schematic representation of the suction valve in a fully closed position.

The first and second suction valves 41, 43 can be any suitable type(s) of valve that can be movable among a fully closed position, a fully open position, and a plurality of intermediate positions between fully open and fully closed. For example, the first and second suction valves 41, 43 could be ball valves (as shown in FIGS. 7-9), variable orifices, or butterfly valves driven by solenoids, stepper motors, or any other suitable actuators. The first and second suction valves 41, 43 can be other device that can create a variable pressure drop of the working fluid entering the respective compressors 12, 14.

As shown in FIGS. 7-9, the first and second suction valves 41, 43 may be ball valves. That is, the first and second suction valves 41, 43 may each include a generally spherical valve member 54 with opposing parallel flat sides 56. An aperture 58 may extend through the flat sides 56 of the valve member 54. The valve member 54 may be received in a socket 60 of a valve housing and may be rotatable within the socket 60 between the fully open position (i.e., a 0% closed position; shown in FIG. 7), the plurality of intermediate positions (one of the intermediate positions (e.g., 50% closed position) is shown in FIG. 8), and the fully closed position (i.e., 100% closed position; shown in FIG. 9). In the fully open position and in the plurality of intermediate positions, fluid can flow through the aperture 58. In the fully closed position, fluid is blocked from flowing through the aperture 58. The closer the valve member 54 is to the fully closed position, the more the valve member 54 restricts flow through the suction inlet 36, and the closer the valve member 54 is to the fully open position, the less the valve member 54 restricts flow through the suction inlet 36. While FIGS. 7-9 depict the suction valves 41, 43 being movable between the fully open (0% closed) and the fully closed (100% closed) positions, in some configurations, the range of motion of the suction valves 41, 43 may be less than 0%-100%. In some configurations, at startup and shutdown of the compressors 12, 14, the suction valves 41, 43 may move to a default position (e.g., the fully open position or one of the intermediate positions) so that if there is a disruption in the electrical connection to the suction valves 41, 43 or a disruption in the control of the suction valves 41, 43, the compressors 12, 14 will still be operational with limited impact to performance.

Figure 4:
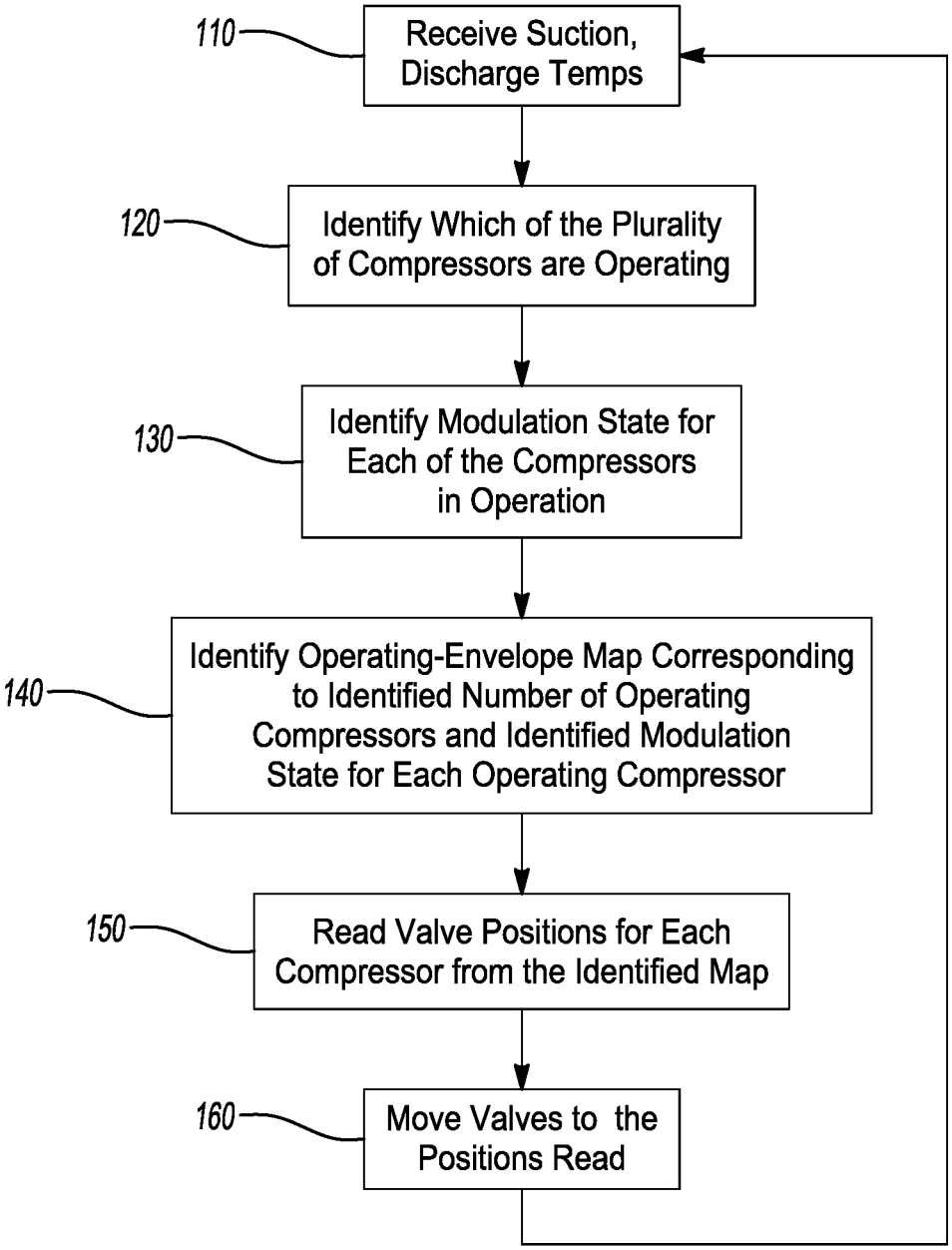
FIG. 4 is a flowchart showing steps performed by the control module to control the suction valves.

The control module 48 can perform the steps shown in FIG. 4 to intermittently or continuously adjust the position of one or both of the first and second suction valves 41, 43 based on operating conditions of the compressors 12, 14 and/or the climate-control system 10 to equalize the pressures of fluid within the suction chambers 30 of the first and second compressors 12, 14.

Figure 3:
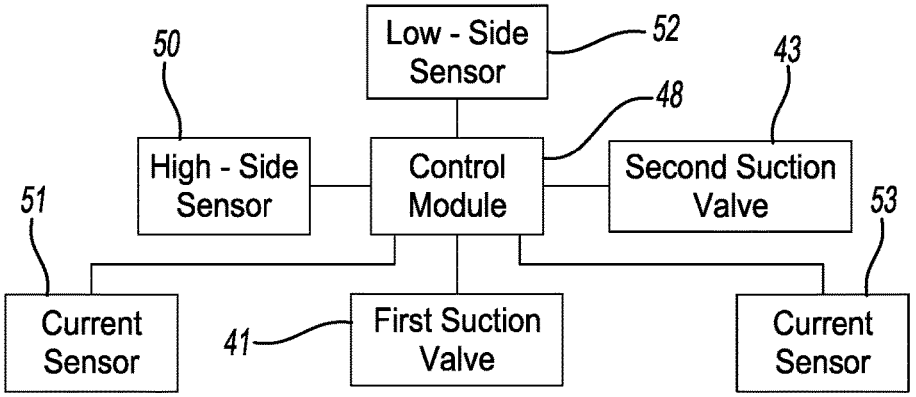
FIG. 3 is a diagram depicting a control module of the climate-control system in communication with sensors and suction valves of the climate-control system.

As shown in FIG. 4, the control module 48 may, at step 110, receive a high-side temperature value (or high-side pressure value) from a high-side sensor 50 (FIGS. 1 and 3) and a low-side temperature value (or low-side pressure value) from a low-side sensor 52 (FIGS. 1 and 3). The high-side sensor 50 may be a temperature sensor (or pressure sensor) disposed along the discharge conduit 44 or on the first heat exchanger 16, for example. Therefore, the high-side temperature value may be a discharge temperature or a condensing temperature. The low-side sensor 52 may be a temperature sensor (or pressure sensor) disposed along the suction conduit 46 or on the second heat exchanger 20, for example. Therefore, the low-side temperature value may be a suction temperature or an evaporating temperature.

At step 120, the control module 48 may identify which one or ones of the compressors 12, 14 are currently operating (i.e., which compressors 12, 14 are not in a shutdown state). This can be done in a variety of ways, including, for example, reading electrical current values from sensors 51, 53 (FIG. 3) measuring electrical current draw of the motors 24 of the compressors 12, 14, reading pressure and/or temperature values from sensors at or near the discharge and/or suction inlets 34, 36 of the compressors 12, 14, and/or referencing the status of other algorithms that the control module 48 performs for controlling, diagnosing and/or protecting the compressors 12, 14. In some configurations, additional or alternative means or steps may be employed by the control module 48 to identify which one or ones of the compressors 12, 14 are currently operating.

At step 130, the control module 48 may identify a modulation state or capacity level of the one or more compressors 12, 14 that were identified at step 120 as currently operating. That is, at step 130, the control module 48 may identify, for each compressor 12, 14 currently operating, whether the compressor(s) 12, 14 are operating at zero capacity, full capacity, or an intermediate capacity level between zero and full. The control module 48 may also identify the value of the intermediate capacity level at which one or more of the compressors 12, 14 may be currently operating. Identifying the capacity levels of the compressors 12, 14 that are operating may be done in a variety of ways, including, for example, reading electrical current values from sensors measuring electrical current draw of the motors 24 of the compressors 12, 14, reading pressure and/or temperature values from sensors at or near the discharge and/or suction inlets 34, 36 of the compressors 12, 14, and/or referencing the status of other algorithms that the control module 48 performs for controlling, diagnosing and/or protecting the compressors 12, 14. In some configurations, additional or alternative means or steps may be employed by the control module 48 to identify the capacity levels of the compressors 12, 14 that are operating.

Figure 5:
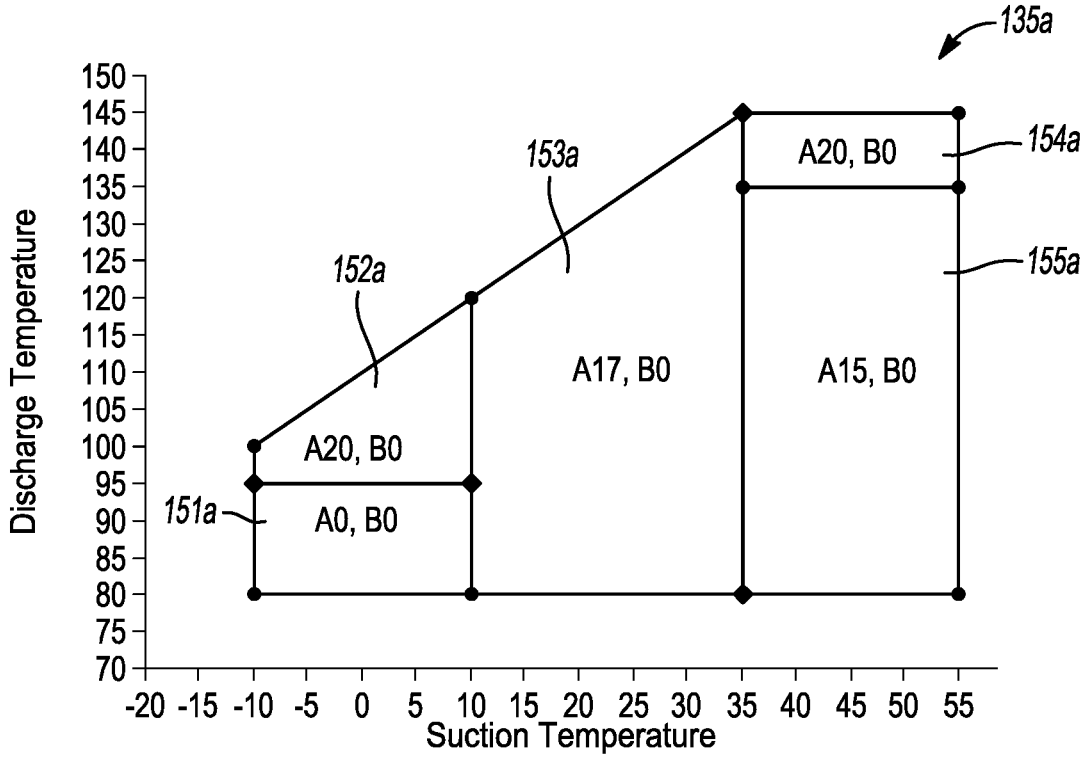
FIG. 5 is an example operating-envelope map according to the principles of the present disclosure.
Figure 6:
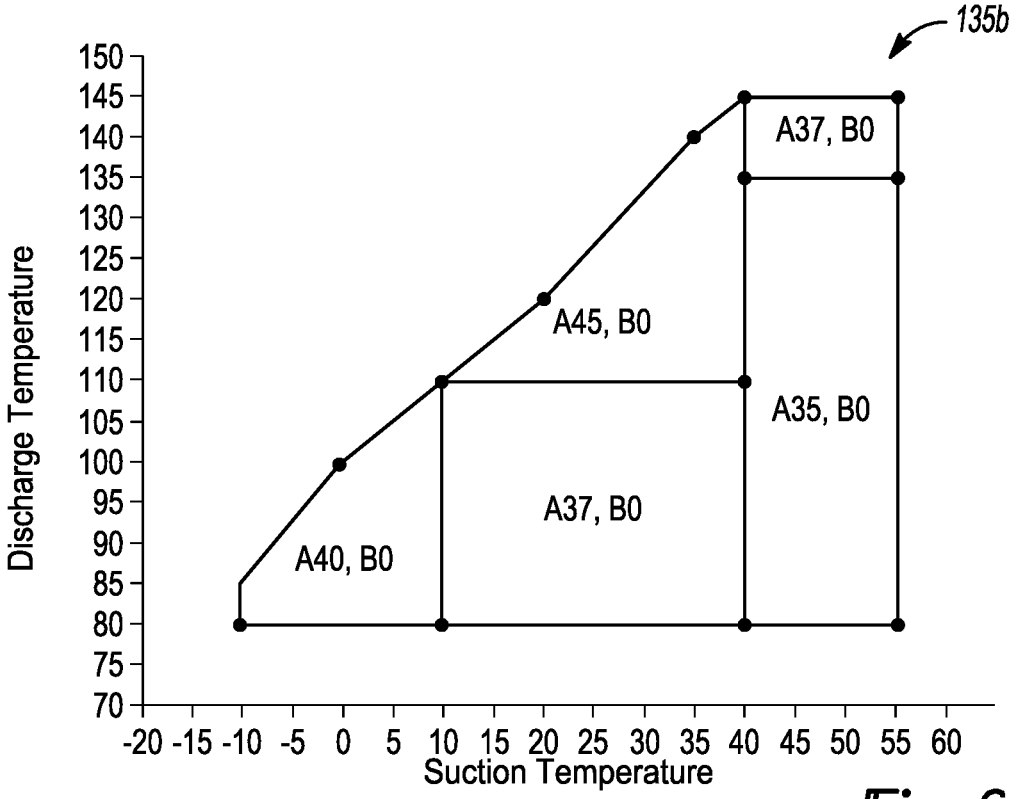
FIG. 6 is another example operating-envelope map according to the principles of the present disclosure.

A plurality of predefined operating-envelope maps may be stored within a memory of the control module 48 or the memory of a module in communication with the control module 48. FIGS. 5 and 6 depict two examples of different operating-envelope maps 135*a*, 135*b* that could be included in the plurality of predefined operating-envelope maps. The plurality of operating-envelope maps stored in the memory may include additional or different operating-envelope maps that correspond to the different combinations of information that could be identified by the control module 48 at steps 120 and 130.

At step 140, the control module 48 may identify one of the operating-envelope maps corresponding to: (a) the identified number of operating compressors 12, 14 (identified in step 120), and (b) the identified modulation state (capacity level) of the operating compressor(s) 12, 14. For example, if the control module 48 determines at steps 120 and 130 that both of the compressors 12, 14 are currently operating and are both operating at an intermediate capacity level, then the control module 48 may identify, at step 140, the one of the operating-envelope maps (such as the operating-envelope map 135*a* shown in FIG. 5) that corresponds to such conditions. As another example, if the control module 48 determines at steps 120 and 130 that both of the compressors 12, 14 are currently operating and the first compressor 12 is operating at an intermediate capacity level and the second compressor 14 is operating at a full capacity level, then the control module 48 may identify, at step 140, the one of the operating-envelope maps (such as the operating-envelope map 135*b* shown in FIG. 6) that corresponds to such conditions. Stored in the memory may be additional operating-envelope maps that correspond to different combinations of conditions identified at steps 120, 130.

Once the operating-envelope map has been identified (at step 140) that corresponds to the current conditions (i.e., the conditions identified at steps 120, 130), then the control module 48 may, at step 150, read the valve positions on the identified operating-envelope map based on the low-side temperature (e.g., suction temperature) value and the high-side temperature (e.g., discharge temperature) value received at step 110. The operating-envelope maps each include a plurality of regions, and each of the regions corresponds to different sets of valve position values.

For example, the operating-envelope map 135*a* shown in FIG. 5 includes a lower left region 151*a* labeled "A0, B0," where A0 indicates a valve position of 0% closed (i.e., fully open) for the first suction valve 41, and B0 indicates a valve position of 0% closed (i.e., fully open) for the second suction valve 43. Therefore, if the temperature values received at step 110 fall within the lower left region 151*a*, then the control module 48 will, at step 150, read the values 0% closed for the first suction valve 41 and 0% closed for the second suction valve 43. An upper left region 152*a* of operating-envelope map 135*a* is labeled "A20, B0," where A20 indicates a valve position of 20% closed for the first suction valve 41, and B0 indicates a valve position of 0% closed (i.e., fully open) for the second suction valve 43. Therefore, if the temperature values received at step 110 fall within the upper left region 152*a*, then the control module 48 will, at step 150, read the values 20% closed for the first suction valve 41 and 0% closed for the second suction valve 43. A central region 153*a* of operating-envelope map 135*a* is labeled "A17, B0," where A17 indicates a valve position of 17% closed for the first suction valve 41, and B0 indicates a valve position of 0% closed (i.e., fully open) for the second suction valve 43. Therefore, if the temperature values received at step 110 fall within the central region 153*a*, then the control module 48 will, at step 150, read the values 17% closed for the first suction valve 41 and 0% closed for the second suction valve 43. An upper right region 154*a* of operating-envelope map 135*a* is labeled "A20, B0," where A20 indicates a valve position of 20% closed for the first suction valve 41, and B0 indicates a valve position of 0% closed (i.e., fully open) for the second suction valve 43. Therefore, if the temperature values received at step 110 fall within the upper right region 154*a*, then the control module 48 will, at step 150, read the values 20% closed for the first suction valve 41 and 0% closed for the second suction valve 43. A lower right region 155*a* of operating-envelope map 135*a* is labeled "A15, B0," where A15 indicates a valve position of 15% closed for the first suction valve 41, and B0 indicates a valve position of 0% closed (i.e., fully open) for the second suction valve 43. Therefore, if the temperature values received at step 110 fall within the lower right region 155*a*, then the control module 48 will, at step 150, read the values 15% closed for the first suction valve 41 and 0% closed for the second suction valve 43. Valve position values can be read in the same manner from the operating-envelope map 135*b* (shown in FIG. 6) and other operating-envelope maps stored in the memory.

At step 160, the control module 48 may move the first and second suction valves 41, 43 to the valve positions read at step 150. Moving the suction valves 41, 43 to the positions read at step 150 will equalize the pressures of fluid within the suction chambers 30 of the first and second compressors 12, 14 so that the lubricant levels in the first and second compressors 12, 14 can be maintained at approximately equal levels or at least at acceptable levels. The operating-envelope maps and the valve position values for each of the regions may be determined and plotted based on testing for a given climate-control system. That is, during testing of a given climate-control system, the valve position values are set so that pressures of fluid within the suction chambers 30 of the first and second compressors 12, 14 are kept approximately equal.

After performing step 160, the control module 48 may loop back and perform steps 110-160 either continuously or intermittently. It will be appreciated that step 110 need not be performed before steps 120, 130, 140. Step 110 could be performed concurrently with any of steps 120, 130, 140 or after any of steps 120, 130, 140.

In some configurations, if only one of the compressors 12, 14 is currently operating and the other one of the compressors 12, 14 is currently shutdown, the control module 48 may move both of the suction valves 41, 41 to the fully open (i.e., 0% closed) position.

In some configurations, the control module 48 may, following step 160, determine lubricant levels in the sumps 40 of the compressors 12, 14 (e.g., from data received from oil-level sensors) and if the lubricant levels in the compressors 12, 14 are not equalizing or if the lubricant levels in one of the compressors 12, 14 is falling below a predetermined acceptable level, the control module 48 may apply a correction factor to adjust the valve position values of the operating-envelope maps to achieve acceptable lubricant levels.

In some configurations, the control module 48 may trigger a fault alert and/or a compressor protection algorithm if adequate lubricant levels are not being maintained in the compressors 12, 14.

While the operating-envelope maps 135*a*, 135*b* shown in the figures include valve positions of 0% closed (i.e., fully open) for the second suction valve 43 at all of the regions of the maps 135*a*, 135*b*, other operating-envelope maps may include different valve positions for the second suction valve 43 at different regions of the maps. For example, in some operating-envelope maps, the position of the first suction valve 41 may be the same at all regions of the map and the positions of the second suction valve 43 may be different at different regions. As another example, in some operating-envelope maps, the positions of the first suction valve 41 may be different at different regions of the map and the positions of the second suction valve 43 may be different at different regions.

While the climate-control system 10 is described above as having two compressors 12, 14 each having a suction valve 41, 43, in some configurations, the climate-control system 10 could have three or more compressors each having a corresponding suction valve. In such configurations, the operating-envelope maps may indicate valve positions for all of the three or more suction valves.

In this application, including the definitions below, the term "module" or the term "control module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

In this application, apparatus elements described as having particular attributes or performing particular operations are specifically configured to have those particular attributes and perform those particular operations. Specifically, a description of an element to perform an action means that the element is configured to perform the action. The configuration of an element may include programming of the element, such as by encoding instructions on a non-transitory, tangible computer-readable medium associated with the element.

The apparatuses and methods described in this application may be partially or fully implemented by a special purpose computer created by configuring a general purpose computer to execute one or more particular functions embodied in computer programs. The figures and descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112 (f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a first compressor including a first shell and a first compression mechanism, the first shell defining a first suction chamber from which the first compression mechanism draws working fluid, the first shell including a first suction inlet through which the working fluid is drawn into the first suction chamber, wherein the working fluid is a refrigerant;

a second compressor including a second shell and a second compression mechanism, the second shell defining a second suction chamber from which the second compression mechanism draws the working fluid, the second shell including a second suction inlet through which the working fluid is drawn into the second suction chamber;

a first suction valve movable between a fully open position and a partially closed position and configured to control a flow of the working fluid through the first suction inlet;

a second suction valve movable between a fully open position and a partially closed position and configured to control a flow of the working fluid through the second suction inlet; and a control module in communication with the first suction valve and the second suction valve and controlling positions of the first suction valve and the second suction valve to control lubricant levels in the first and second shells, wherein the control module controls the positions of the first and second suction valves based on which of the first and second compressors are operating and which are in a shutdown state, wherein the control module controls the positions of the first and second suction valves based on capacity levels of the first and second compressors, and wherein the control module controls the positions of the first and second suction valves based on data received from a high-side sensor and a low-side sensor.

2. The climate-control system of claim 1, wherein the high-side sensor is disposed upstream of an expansion device and downstream of discharge outlets of the first and second compressors, and wherein the low-side sensor is disposed downstream of the expansion device and upstream of the first and second suction inlets.

3. The climate-control system of claim 1, further comprising an evaporator and a suction manifold providing fluid communication between the evaporator and the first and second compressors, wherein the first and second suction valves control a flow of the working fluid through the suction manifold.

4. The climate-control system of claim 1, wherein the first compression mechanism is disposed within the first suction chamber, and wherein the second compression mechanism is disposed within the second suction chamber.

5. The climate-control system of claim 1, wherein the first and second suction valves are disposed in the first and second suction inlets, respectively.

6. The climate-control system of claim 1, wherein both of the first and second suction valves are movable between the fully open position and a fully closed position.

7. The climate-control system of claim 1, wherein the first and second suction valves are ball valves.

8. A climate-control system comprising:

a first compressor including a first shell and a first compression mechanism, the first shell defining a first suction chamber from which the first compression mechanism draws working fluid, the first shell including a first suction inlet through which the working fluid is drawn into the first suction chamber, wherein the working fluid is a refrigerant;

a second compressor including a second shell and a second compression mechanism, the second shell defining a second suction chamber from which the second compression mechanism draws the working fluid, the second shell including a second suction inlet through which the working fluid is drawn into the second suction chamber;

a first suction valve movable between a fully open position and a partially closed position and configured to control a flow of the working fluid through the first suction inlet;

a second suction valve movable between a fully open position and a partially closed position and configured to control a flow of the working fluid through the second suction inlet; and a control module in communication with the first suction valve and the second suction valve and controlling positions of the first suction valve and the second suction valve to control lubricant levels in the first and second shells, wherein the positions of the first and second suction valves are determined based on a predefined operating-envelope map.

9. The climate-control system of claim 8, wherein the control module controls the positions of the first and second suction valves based on which of the first and second compressors are operating and which are in a shutdown state, wherein the control module controls the positions of the first and second suction valves based on capacity levels of the first and second compressors, and wherein the control module controls the positions of the first and second suction valves based on data received from a high-side sensor and a low-side sensor.

10. The climate-control system of claim 9, wherein the high-side sensor is disposed upstream of an expansion device and downstream of discharge outlets of the first and second compressors, and wherein the low-side sensor is disposed downstream of the expansion device and upstream of the first and second suction inlets.

11. The climate-control system of claim 8, further comprising an evaporator and a suction manifold providing fluid communication between the evaporator and the first and second compressors, wherein the first and second suction valves control a flow of the working fluid through the suction manifold.

12. The climate-control system of claim 8, wherein the first compression mechanism is disposed within the first suction chamber, and wherein the second compression mechanism is disposed within the second suction chamber.

13. The climate-control system of claim 8, wherein the first and second suction valves are disposed in the first and second suction inlets, respectively.

14. The climate-control system of claim 8, wherein both the first and second suction valves are movable between the fully open position and a fully closed position.

15. The climate-control system of claim 8, wherein the first and second suction valves are ball valves.

16. A climate-control system comprising:

a first compressor including a first shell and a first compression mechanism, the first shell defining a first suction chamber from which the first compression mechanism draws working fluid, the first shell including a first suction inlet through which the working fluid is drawn into the first suction chamber, wherein the working fluid is a refrigerant;

a second compressor including a second shell and a second compression mechanism, the second shell defining a second suction chamber from which the second compression mechanism draws the working fluid, the second shell including a second suction inlet through which the working fluid is drawn into the second suction chamber;

a lubricant equalization conduit extending between the first and second compressors and in fluid communication with lubricant sumps of the first and second compressors;

a first suction valve movable between a fully open position and a partially closed position and configured to control a flow of the working fluid through the first suction inlet;

a second suction valve movable between a fully open position and a partially closed position and configured to control a flow of the working fluid through the second suction inlet; and a control module in signal communication with the first suction valve and the second suction valve and configured to control movement of the first and second suction valves independently of each other, wherein the control module is configured to equalize pressures within the first and second suction chambers by controlling positions of the first suction valve and the second suction valve to maintain lubricant levels in the lubricant sumps of the first and second compressors above the lubricant equalization conduit.

17. The climate-control system of claim 16, wherein the positions of the first and second suction valves are determined based on a predefined operating-envelope map.

18. The climate-control system of claim 16, wherein the control module controls the positions of the first and second suction valves based on which of the first and second compressors are operating and which are in a shutdown state, wherein the control module controls the positions of the first and second suction valves based on capacity levels of the first and second compressors, and wherein the control module controls the positions of the first and second suction valves based on data received from a high-side sensor and a low-side sensor.

19. The climate-control system of claim 18, wherein the high-side sensor is disposed upstream of an expansion device and downstream of discharge outlets of the first and second compressors, and wherein the low-side sensor is disposed downstream of the expansion device and upstream of the first and second suction inlets.

20. The climate-control system of claim 16, further comprising an evaporator and a suction manifold providing fluid communication between the evaporator and the first and second compressors, wherein the first and second suction valves control a flow of the working fluid through the suction manifold.

* * * * *